US009297545B2

(12) United States Patent
Choo et al.

(10) Patent No.: US 9,297,545 B2
(45) Date of Patent: Mar. 29, 2016

(54) DAMPER STRUCTURE FOR A SEALED DERRICK

(75) Inventors: Keum Dae Choo, Gyeongsangnam-do (KR); D. Scott Brittin, Katy, TX (US)

(73) Assignees: Daewoo Shipbuilding & Marine Engineering Co., Ltd., Seoul (KR); Transocean Sedco Forex Ventures Limited, George Town (KY)

( * ) Notice: Subject to any disclaimer, the term of this patent is extended or adjusted under 35 U.S.C. 154(b) by 116 days.

(21) Appl. No.: 13/881,369

(22) PCT Filed: Jun. 22, 2011

(86) PCT No.: PCT/KR2011/004556

§ 371 (c)(1), (2), (4) Date: Jul. 12, 2013

(87) PCT Pub. No.: WO2012/060528

PCT Pub. Date: May 10, 2012

(65) Prior Publication Data

US 2013/0277062 A1 Oct. 24, 2013

(30) Foreign Application Priority Data

Nov. 4, 2010 (KR) ..... 10-2010-0109026

(51) Int. Cl.

| | |
|---|---|
| ***E21B 15/02*** | (2006.01) |
| ***F24F 11/00*** | (2006.01) |
| ***B63J 2/02*** | (2006.01) |
| *B63B 35/08* | (2006.01) |
| *B63B 35/44* | (2006.01) |

(52) U.S. Cl.

CPC ..... *F24F 11/0001* (2013.01); *B63J 2/02* (2013.01); *E21B 15/02* (2013.01); *B63B 35/08* (2013.01); *B63B 35/4413* (2013.01)

(58) Field of Classification Search

CPC ..... B63J 2/10; B63B 35/44; B63B 35/4413; B63B 2035/448; E21B 15/62

USPC ..... 166/352, 355, 358

See application file for complete search history.

(56) References Cited

U.S. PATENT DOCUMENTS

| | | | |
|---|---|---|---|
| 2,153,350 | A | 4/1939 | Stimac |
| 2,691,272 | A | 10/1954 | Townsend et al. |
| 2,804,951 | A | 9/1957 | Kolt |
| 3,093,056 | A | 6/1963 | Rosenfeld |
| 3,279,407 | A | 10/1966 | Stenger |
| 3,461,828 | A | 8/1969 | Bielstein |

(Continued)

FOREIGN PATENT DOCUMENTS

| | | | |
|---|---|---|---|
| GB | 611961 | A | 11/1948 |
| GB | 1 218 530 | A | 1/1971 |

(Continued)

*Primary Examiner* — Matthew R Buck
*Assistant Examiner* — Patrick Lambe
(74) *Attorney, Agent, or Firm* — Seed IP Law Group PLLC

(57) ABSTRACT

Provided is a damper structure for an enclosed derrick, which can constantly compensate and maintain a pressure of an inner space of an enclosed derrick structure. The damper structure for the enclosed derrick includes: one or more communication ducts installed in a side of the enclosed derrick; and one or more open/close dampers coupled to the communication ducts to open or close the communication ducts, whereby air is selectively supplied to or exhausted from the enclosed derrick.

6 Claims, 1 Drawing Sheet

(56) References Cited

U.S. PATENT DOCUMENTS

| | | | | |
|---|---|---|---|---|
| 3,593,645 | A | 7/1971 | Day et al. | |
| 3,626,836 | A | 12/1971 | Schneidler | |
| 3,850,125 | A * | 11/1974 | Anders | 114/40 |
| 4,053,732 | A | 10/1977 | Carter | |
| 4,407,185 | A | 10/1983 | Haines et al. | |
| 4,487,214 | A | 12/1984 | Tatum | |
| 4,613,001 | A | 9/1986 | Edberg et al. | |
| 4,627,767 | A | 12/1986 | Field et al. | |
| 4,666,341 | A | 5/1987 | Field et al. | |
| 4,991,532 | A | 2/1991 | Locke | |
| 5,927,222 | A * | 7/1999 | Eakin et al. | 114/45 |
| 7,413,007 | B2 | 8/2008 | Yamaoka | |
| 2003/0196791 | A1 | 10/2003 | Dunn et al. | |
| 2005/0191136 | A1 | 9/2005 | Xu | |
| 2008/0009233 | A1 | 1/2008 | Leseman et al. | |
| 2008/0115998 | A1 | 5/2008 | Naganuma et al. | |
| 2010/0291857 | A1 | 11/2010 | Cho et al. | |

FOREIGN PATENT DOCUMENTS

| | | | |
|---|---|---|---|
| GB | 2 110 602 | A | 6/1983 |
| JP | 60-62394 | A | 4/1985 |
| JP | 60-126589 | U | 8/1985 |
| JP | 2-100994 | U | 8/1990 |
| JP | 3002545 | B2 | 1/2000 |
| JP | 2000238695 | A | 9/2000 |
| JP | 2005-306315 | A | 11/2005 |
| KR | 20-0226940 | Y1 | 6/2001 |
| KR | 10-2004-0020440 | A | 3/2004 |
| KR | 20-0431766 | Y1 | 11/2006 |
| KR | 10-2009-0053184 | A | 5/2009 |
| KR | 10-2010-0028480 | A | 3/2010 |
| UA | 63-6998 | U | 1/1988 |
| WO | 97-42393 | A1 | 11/1997 |

* cited by examiner

DAMPER STRUCTURE FOR A SEALED DERRICK

CROSS-REFERENCE(S) TO RELATED APPLICATION

This application is a national stage application filed under 35 U.S.C. §371 of International Application No. PCT/KR2011/004556, accorded an International Filing Date of Jun. 22, 2011, which claims priority of Korean Patent Application No. 10-2010-0109026, filed on Nov. 4, 2010, in the Korean Intellectual Property Office, which is hereby incorporated by reference in its entirety.

BACKGROUND

1. Technical Field

The present disclosure relates to a damper structure, and more particularly, to a damper structure for an enclosed derrick, which can constantly compensate and maintain a pressure of an inner space of an enclosed derrick structure.

2. Description of the Related Art

Due to the rapid international industrialization and industrial development, the use of the earth's resources, such as oil, is gradually increasing. Accordingly, stable production and supply of oil is emerging as a very important worldwide issue.

For this reason, much attention has recently been paid to development of small marginal fields or deep-sea oil fields, which have been ignored because of their low economic feasibility. Therefore, with the development of offshore drilling techniques, drill ships equipped with drilling equipment suitable for development of such oil fields have been developed.

In conventional offshore drilling, rig ships or fixed type platforms have been mainly used, which can be moved only by tugboats and are anchored at a position on the sea using a mooring gear to conduct an oil drilling operation. In recent years, however, so-called drill ships have been developed and used for offshore drilling. The drill ships are provided with advanced drilling equipment and have structures similar to typical ships such that they can make a voyage using their own power. Since drill ships have to frequently move in order for development of small marginal fields, they are constructed to make a voyage using their own power, without assistance of tugboats.

Meanwhile, a moonpool is formed at the center of a rig ship, a fixed type platform or a drill ship, such that a riser or a drill pipe is vertically movable through the moonpool. In addition, a derrick in which a variety of drilling equipment is integrated is installed on a deck.

BRIEF SUMMARY

An aspect of the present invention is directed to a damper structure for an enclosed derrick, which can effectively compensate or offset a negative pressure or a positive pressure generated within an enclosed derrick and a moonpool due to influence of waves on the moonpool.

Meanwhile, in order for drilling of natural resources in extremely cold regions such as arctic regions, arctic rig ships, fixed type arctic platforms, and arctic ships such as arctic drill ships have been built. Such arctic ships may be constructed to have an enclosed area in almost all zones in order to prevent freezing in extremely low temperature environments and ensure the smooth operation of equipments and crews' safety.

In particular, a derrick and a moonpool of an arctic ship are enclosed in order to protect internal equipment and workers.

The enclosed derrick and the enclosed moonpool may be installed to communicate with each other.

Meanwhile, due to influence of waves transferred through an opening of the moonpool, a negative pressure or a positive pressure may be generated in the inner space of the moonpool and the inner space of the derrick communicating with the moonpool. Therefore, there is a need for protecting equipment, workers, and working conditions inside the derrick and the moonpool from the negative pressure or the positive pressure.

According to an embodiment of the present invention, a damper structure for an enclosed derrick includes: one or more communication ducts installed in a side of the enclosed derrick; and one or more open/close dampers coupled to the communication ducts to open or close the communication ducts, whereby air is selectively supplied to or exhausted from the enclosed derrick.

One end of the communication duct may communicate with an outer space of the enclosed derrick, and a first mesh may be installed at the end of the communication duct.

The other end of the communication duct may communicate with an inner space of the inner space of the enclosed derrick, a second mesh may be installed at the other end of the communication duct, and the open/close damper may be installed between the other end of the communication duct and the second mesh.

The damper structure may further include a control unit controlling the opening/closing operation of the open/close damper.

The communication duct may include: a curved duct having one end which is inclined downward and communicates with an outer space of the enclosed derrick and at which a first mesh is installed; and a penetration duct installed in a sidewall of the enclosed derrick, the penetration duct having one end which is coupled to the other end of the curved duct, and the other end at which a second mesh is installed, whereby the penetration duct communicates with an inner space of the enclosed derrick.

According to another embodiment of the present invention, a damper structure includes: an enclosed derrick disposed on a drill floor of a ship; a moonpool communicably coupled to a lower portion of the enclosed derrick; and a damper unit installed in at least one side of the enclosed derrick to selectively supply air to the inside of the enclosed derrick or exhaust air to the outside of the enclosed derrick.

The damper unit may include: one or more communication ducts installed in a side of the enclosed derrick to communicate an outer space of the enclosed derrick with an inner space of the enclosed derrick; and one or more open/close valves coupled to the communication ducts to open or close the communication ducts.

A fingerboard may be disposed in an upper inside of the enclosed derrick, and the damper unit may be disposed under the fingerboard.

According to another embodiment of the present invention, a damper structure for an enclosed derrick communicating with a moonpool includes: a damper unit selectively supplying air to the inside of the enclosed derrick or exhausting air to the outside of the enclosed derrick in order to compensate or offset a positive pressure or a negative pressure which is generated in the moonpool by influence of waves.

DETAILED DESCRIPTION OF EXEMPLARY EMBODIMENTS

Exemplary embodiments of the present invention will be described below in detail with reference to the accompanying drawings.

Figure 1:
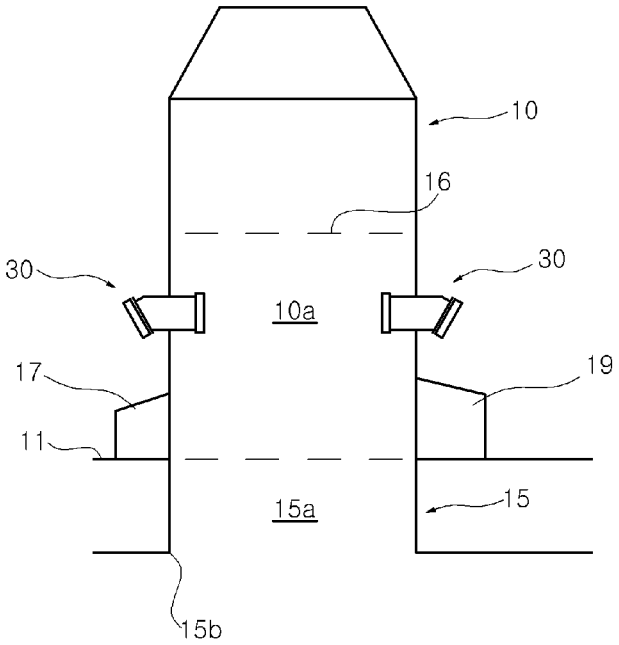
FIG. 1 is a schematic view illustrating an enclosed derrick structure and a damper unit installed therein according to an embodiment of the present invention.
Figure 2:
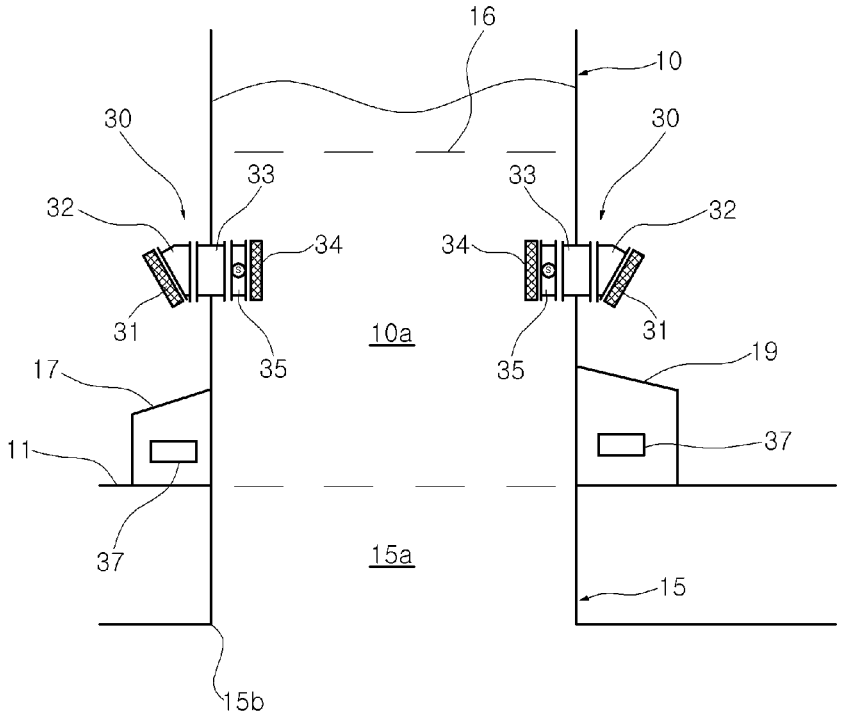
FIG. 2 is an enlarged view illustrating the connection of a moonpool and a duct.

FIGS. 1 and 2 illustrate an enclosed derrick structure and a damper unit installed therein according to an embodiment of the present invention.

As illustrated in FIGS. 1 and 2, the enclosed derrick structure according to the embodiment of the present invention includes an enclosed derrick 10 installed in a ship, and an enclosed moonpool 15 coupled to a lower portion of the enclosed derrick 10.

The enclosed derrick 10 has a first inner space 10*a*, and the enclosed moonpool 15 has a second inner space 15*a*. The first inner space 10*a* and the second inner space 15*a* are coupled to communicate with each other. The enclosed derrick 10 is disposed on a drill floor 11 of the ship, and the enclosed moonpool 15 is disposed under the drill floor 11.

An outer wall of the enclosed derrick 10 is formed in an enclosed structure, and first and second enclosed tunnels 17 and 19 are provided in a side of the enclosed derrick 10. Openings are formed at the ends of the first and second enclosed tunnels 17 and 19, such that equipment such as a riser can be passed therethrough.

Meanwhile, an inlet/output port 15*b* is formed at a lower portion of the moonpool 15, and seawater waves may be transferred through the inlet/output port 15*b*. Due to the influence of waves, excessive negative pressure or positive pressure may be generated in the first and second inner spaces 10*a* and 15*a*.

Therefore, one or more damper units 30 are installed in at least one side of the enclosed derrick 10. Since air is supplied to or discharged from the first inner space 10*a* by the damper unit 30, it is possible to compensate or offset the excessive negative pressure or positive pressure generated in the first and second inner spaces 10*a* and 15*a*. Thus, the pressures of the first and second inner spaces 10*a* and 15*a* can be constantly maintained, thereby safely protecting internal equipments, workers, and working conditions.

The damper unit 30 includes one or more communication ducts which are installed in a side of the enclosed derrick 10 and communicate the outer space of the enclosed derrick 10 with the inner space of the enclosed derrick 10. As one example, the communication duct includes a curved duct 32 and a straight penetration duct 33. An open/close damper 35 is installed in the curved duct 32 and the penetration duct 33 to selectively open or close the curved duct 32 and the penetration duct 33.

In particular, the damper unit 30 may be disposed under a fingerboard 16, such that the operation of compensating and offsetting the pressures of the first and second inner spaces 10*a* and 15*a* is effectively performed.

One end of the curved duct 32 is inclined downward and communicates with the outer space of the enclosed derrick 10, and a first mesh 31 is installed at the end of the curved duct 32. The other end of the penetration duct 33 communicates with the first inner space 10*a*, and a second mesh 34 is installed at the other end of the penetration duct 33. An open/close damper 35 is installed between the other end of the penetration duct 33 and the second mesh 34. The first and second meshes 31 and 34 can minimize the inflow of external particles.

It is preferable that the penetration duct 33 is coupled to the other end of the curved duct 32, and the penetration duct 33 is fixed to the sidewall of the enclosed derrick 10.

When an excessive positive pressure (more than 25 Pa) and an excessive negative pressure (less than −75 Pa) are generated in the inside of the enclosed derrick 10, the open/close damper 35 may be opened or closed manually or automatically in order to offset the excessive positive or negative pressure of the enclosed derrick. In addition, the open/close damper 35 may be selectively closed to block an air flow in the event of a fire or other emergency.

A control unit 37 is installed in one side of the enclosed derrick 10 to control the opening/closing operation of the open/close damper 35. The control unit 37 may be installed in the first and second enclosed tunnels 17 and 19. The control unit 37 detects an internal pressure state of the enclosed derrick 10 in real time and controls the opening/closing operation of the open/close damper 35 manually or automatically. In this manner, the control unit 37 may control the internal pressure of the enclosed derrick 10 by supplying air to the inside of the enclosed derrick 10 or exhausting air to the outside of the enclosed derrick 10.

According to the embodiments of the present invention, the negative pressure or the positive pressure generated in the enclosed derrick 10 and the moonpool 15 due to influence of waves transferred to the moonpool 15 can be effectively compensated or offset, thereby safely protecting internal equipment, workers and working conditions inside the enclosed derrick 10 and the moonpool 15.

Furthermore, the downwardly curved duct 32 and the first and second meshes 31 and 34 can minimize the inflow of external rainwater or foreign particles.

While the embodiments of the present invention have been described with reference to the specific embodiments, it will be apparent to those skilled in the art that various changes and modifications may be made without departing from the spirit and scope of the invention as defined in the following claims. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A derrick of a drill ship, the derrick comprising:

an enclosed derrick structure extending upwardly from a floor of the drill ship and defining an enclosed interior working space above the floor of the drill ship; and a damper structure to assist in controlling air pressure within the enclosed interior working space of the enclosed derrick structure, the damper structure comprising:

one or more air communication ducts installed to penetrate through a side of the enclosed derrick structure and being exposed to air of the atmospheric environment outside of the enclosed derrick structure at the side of the enclosed derrick structure; and one or more open/close dampers coupled to the air communication ducts to open or close the air communication ducts to enable air to be selectively supplied to or exhausted from the enclosed interior working space of the enclosed derrick structure to assist in controlling the air pressure within the enclosed interior working space of the enclosed derrick structure, and wherein one end of each of the one or more air communication ducts communicates with the air of the atmospheric environment outside of the enclosed derrick structure, and a respective first mesh is installed at the end of each of the one or more air communication ducts.

2. The derrick according to claim 1, wherein the other end of each of the one or more communication ducts communicates with an inner space of the enclosed derrick structure, a respective second mesh is installed at the other end of each of the one or more communication ducts, and a respective one of the one or more open/close dampers is installed between the other end of each of the one or more communication ducts and the respective second mesh.

3. The derrick according to claim 1, further comprising a control unit controlling the opening/closing operation of the one or more open/close dampers.

4. The derrick according to claim 1, wherein, for each of the one or more communication ducts, the communication duct comprises:

a curved duct having one end which is inclined downward and communicates with the air of the atmospheric environment outside of the enclosed derrick structure and at which the first mesh is installed; and a penetration duct installed in a sidewall of the enclosed derrick structure, the penetration duct having one end which is coupled to the other end of the curved duct, and the other end at which a second mesh is installed, whereby the penetration duct communicates with an inner space of the enclosed derrick structure.

5. A damper structure comprising:

an enclosed derrick disposed on a drill floor of a ship, the enclosed derrick extending upwardly from the drill floor of the ship and defining an enclosed interior working space above the floor of the drill ship;

a moonpool communicably coupled to a lower portion of the enclosed derrick; and a damper unit installed in at least one side of the enclosed derrick above the drill floor of the ship to selectively supply air to the inside of the enclosed derrick or exhaust air to the outside of the enclosed derrick to assist in controlling air pressure within the enclosed interior working space of the enclosed derrick, wherein the damper unit comprises:

one or more air communication ducts installed to penetrate a side of the enclosed derrick above the floor of the drill ship and exposed to air of the atmospheric environment outside of the enclosed derrick to communicate an outside space of the enclosed derrick with the enclosed interior working space of the enclosed derrick;

one or more open/close valves coupled to the air communication ducts to open or close the air communication ducts; and a respective mesh installed at one end of each of the one or more air communication ducts.

6. The damper structure according to claim 5, wherein a fingerboard is disposed in an upper inside of the enclosed derrick, and the damper unit is disposed under the fingerboard.

* * * * *